US005751110A

United States Patent [19]

Spaapen et al.

[11] Patent Number: 5,751,110

[45] Date of Patent: May 12, 1998

[54] ELECTRODELESS LOW-PRESSURE DISCHARGE LAMP

[75] Inventors: Antonius J. Spaapen, Roosendaal; Johannes T.J. Van Haastrecht; Theodorus J.M.J. Van Gennip, both of Eindhoven, all of Netherlands

[73] Assignee: U.S. Philips Corporation, New York, N.Y.

[21] Appl. No.: 776,449

[22] PCT Filed: May 21, 1996

[86] PCT No.: PCT/IB96/00480

§ 371 Date: Jan. 24, 1997

§ 102(e) Date: Jan. 24, 1997

[87] PCT Pub. No.: WO96/37909

PCT Pub. Date: Nov. 28, 1996

[30] Foreign Application Priority Data

May 24, 1995 [EP] European Pat. Off. ..... 95201371

[51] Int. Cl.[6] ..... H01J 65/04

[52] U.S. Cl. ..... 313/550; 313/607; 313/234; 313/545; 315/248

[58] Field of Search ..... 313/607, 234, 313/545, 550; 315/248

[56] References Cited

U.S. PATENT DOCUMENTS

| | | | |
|---|---|---|---|
| 4,622,495 | 11/1986 | Smeelan | 313/550 X |
| 5,412,288 | 5/1995 | Borowiec et al. | 315/248 |
| 5,434,482 | 7/1995 | Borowiec et al. | 315/248 |
| 5,559,392 | 9/1996 | Cocoma et al. | 313/550 X |

*Primary Examiner*—Nimeshkumar Patel
*Attorney, Agent, or Firm*—Walter M. Egbert, III

[57] ABSTRACT

An electrodeless low-pressure discharge lamp is provided with a lamp vessel which is closed in a gastight manner, which surrounds a discharge space, and which contains a filling of mercury and rare gas. The lamp vessel has a cavity and a collar where the cavity is open towards the exterior, an electric coil being accommodated in the cavity and support with an amalgam being arranged in the discharge space. The collar is made of metal and the support of the amalgam is fastened to the collar. This construction counteracts degeneration of the amalgam.

11 Claims, 2 Drawing Sheets

ELECTRODELESS LOW-PRESSURE DISCHARGE LAMP

BACKGROUND OF THE INVENTION

The invention relates to an electrodeless low-pressure discharge lamp provided with a lamp vessel which is closed in a gastight manner, which surrounds a discharge space, which contains a filling of mercury and a rare gas, and which has a cavity and a collar where said cavity is open towards the exterior, an electric coil being accommodated in said cavity while a support with an amalgam is positioned in the discharge space.

Such a lamp is known from U.S. Pat. No. 4,622,495. A high-frequency magnetic field is generated by the electric coil during lamp operation, maintaining an electric discharge in the lamp vessel. The cavity and the collar are integrally formed from a glass tube. A portion of the lamp vessel surrounding the cavity is fused to the outer circumference of the collar. The amalgam is provided on a metal gauze which is fastened to the cavity by means of a rod. The electric discharge arising after lamp ignition heats the support with the amalgam, so that the latter releases mercury bound thereto. The released mercury vapor achieves that the light output rises quickly after ignition up to a value desired for nominal operation. It is a disadvantage, however, that the amalgam degenerates comparatively strongly during lamp life.

SUMMARY OF THE INVENTION

It is an object of the invention to provide an electrodeless low-pressure discharge lamp of the kind described in the opening paragraph which has a construction which counteracts degeneration of the amalgam.

According to the invention, the electrodeless low-pressure discharge lamp of the kind described in the opening paragraph is for this purpose characterized in that the collar is made of metal and the support is fastened to the collar.

Amalgam temperature is dependent not only on the discharge temperature but also partly on the temperature of the location where the amalgam support is fastened to the lamp vessel. The temperature of the cavity to which the amalgam support is fastened in the known lamp rises comparatively slowly from room temperature to a value which may be higher by 200° C. or more. The result of this is that the amalgam temperature after an initial steep rise increases further gradually and does not stop increasing until the cavity has assumed its equilibrium temperature. The amalgam temperature then assumes values which are higher than those necessary for the release of mercury, which causes a strong degeneration of the amalgam.

The metal collar to which the amalgam is fastened in the lamp according to the invention undergoes a substantially smaller temperature rise after lamp ignition. This renders it possible to position the amalgam such that it quickly assumes a temperature necessary for the release of mercury, while the subsequent temperature rise, and thus the extent to which the amalgam degenerates during life, is limited.

The collar may be made from a metal which has a coefficient of expansion corresponding to that of the glass of the lamp vessel, for example, in the case of lime glass a CrNiFe alloy, for example Cr 6%, Ni 42%, remainder Fe by weight. In a hard-glass lamp vessel, for example of borosilicate glass, it is possible to use, for example, a collar of Ni/Fe or NiCoFe, for example Ni 29%, Co 17%, remainder Fe by weight.

Suitable materials for forming an amalgam with mercury are, for example, indium or an alloy of lead and tin. The amalgam may be provided, for example, in an open capsule. It is favorable, however, when the amalgam constitutes a layer on a surface of the support. Suitable materials on which the amalgam may be provided are, for example, stainless steel, iron, nickel. An intermediate layer may be present between the amalgam and the surface of the support on which the amalgam is provided so as to promote the adhesion of the amalgam to the support, for example an intermediate layer of cobalt or an intermediate layer of an alloy of the amalgam-forming material and the support material.

The support may be, for example, a single body, for example a strip fastened at one end portion to the collar and provided with the amalgam at an opposed end portion. In a favorable embodiment, the support comprises a first part, for example a gauze strip, on which the amalgam is provided, and a second part, such as a metal rod, by means of which the first part is fastened to the collar. It is an advantage of this embodiment that a comparatively large surface area may be readily realized for an interaction between the amalgam and the discharge space by means of the first part of the support, while the heat transport to the collar can be controlled independently thereof through the second part.

In an attractive embodiment, at least a portion of the amalgam is provided on an inward-facing surface of a curved leaf-shaped body. In this embodiment the leaf-shaped body protects the amalgam on said surface from sputtering away under the influence of high-energy particles from the discharge. The leaf-shaped body is, for example, bent into a spiral shape. In a modification of this embodiment, the amalgam extends from said surface also further over an exposed surface. On the one hand, the amalgam on this exposed surface may readily release mercury vapor into the discharge. On the other hand, amalgam disappearing from the exposed surface owing to sputtering can be supplemented through migration from the inward-facing surface.

In an advantageous embodiment, the amalgam support is fastened to the collar with a weld. The weld may be obtained, for example, by resistance welding or arc welding. It is attractive to fasten the rod to the collar by laser welding. This also renders it possible to obtain a weld after a luminescent layer (which is not electrically conducting) has been provided on the collar.

Besides the amalgam in the discharge space, the lamp may comprise, for example, a further, vapor pressure controlling amalgam which is arranged in a comparatively cold spot and which has for its object to limit influences of the ambient temperature on the mercury vapor pressure. Alternatively, a vapor pressure controlling amalgam may be absent. The mercury vapor pressure during nominal operation is determined in that case by the temperature of the coldest spot of the lamp vessel wall.

An attractive embodiment of the lamp according to the invention is characterized in that the lamp vessel carries a light-transmitting, electrically conducting layer on a surface facing the discharge space, which layer extends from the collar over at least a further portion of the lamp vessel. The collar may then serve as a lead-through member for connecting the electrically conducting layer to an external conductor. This renders it possible in a simple manner to suppress radio interference of the lamp in that the collar is connected to a mains conductor during lamp operation.

BRIEF DESCRIPTION OF THE DRAWINGS

These and other aspects of the lamp according to the invention will be explained in more detail with reference to the drawing, in which.

DESCRIPTION OF THE PREFERRED EMBODIMENTS

Figure 1:
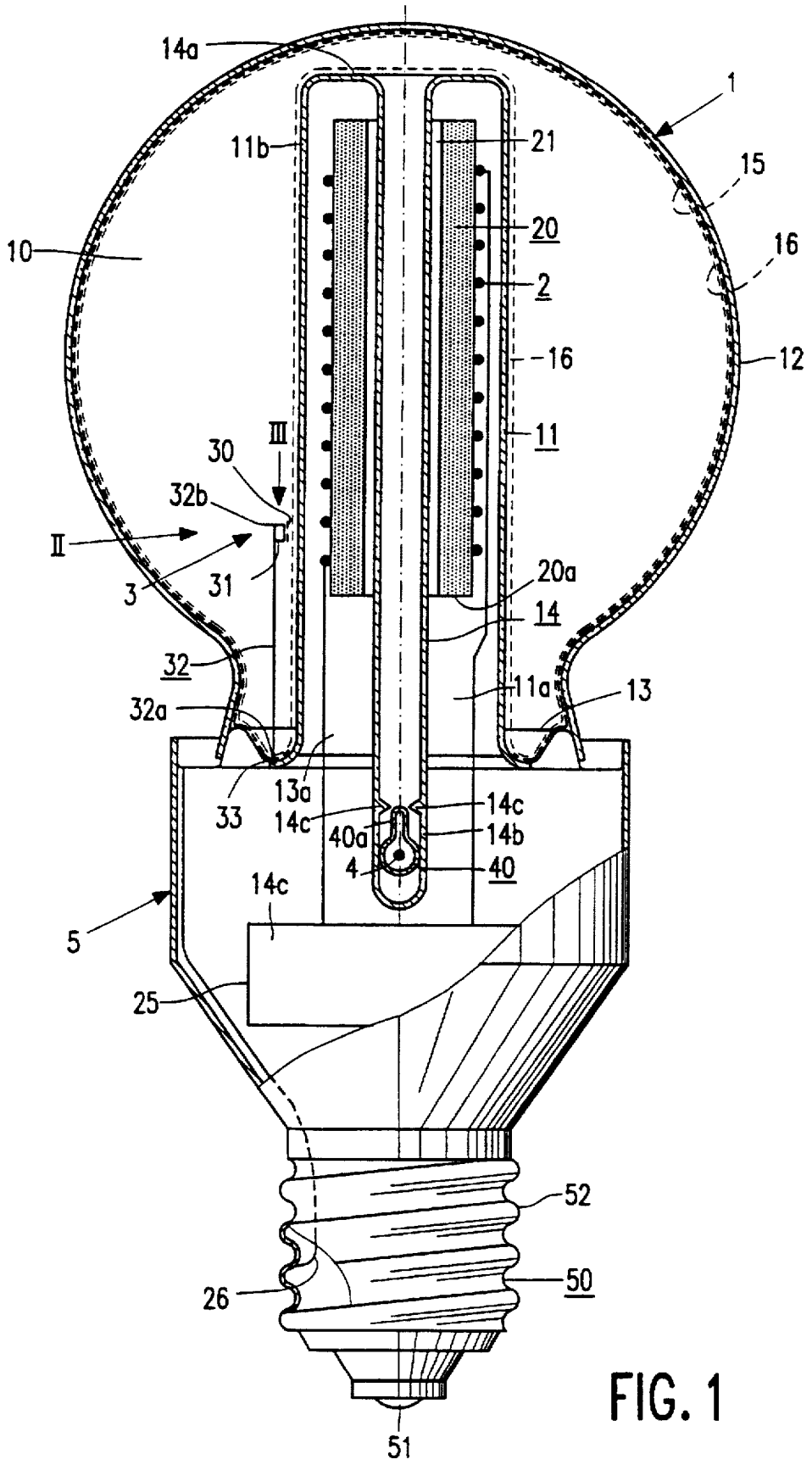
FIG. 1 shows a first embodiment of the electrodeless low-pressure discharge lamp according to the invention, partly in elevation and partly in longitudinal sectional view.

FIG. 1 shows an electrodeless low-pressure discharge lamp provided with a lamp vessel 1 which is closed in a gastight manner, which surrounds a discharge space 10, and which is provided with an ionizable filling. The filling comprises mercury and a krypton/argon mixture (95/5 by volume). The lamp vessel 1 has a cavity 11 and a collar 13 where the cavity 11 is open towards the exterior. The collar 13 has an opening 13*a* which affords access to a space 11*a* in the cavity 11 where an electric coil 2 is accommodated, which coil surrounds a hollow core 20 of soft magnetic material. The core has a length of 45 mm, an internal diameter of 7.5 mm, and an external diameter of 12.5 mm. A support 3 with an amalgam 30, called auxiliary amalgam hereinafter, is arranged in the discharge space 10. An exhaust tube 14, which has an open end 14*a* in an end 11*b* of the cavity facing away from the collar 13, extends through the cavity 21 in the core 20 of the coil 2. Opposite the open end 14*a*, the exhaust tube 14 has an end portion 14*b* in which a further, vapor pressure controlling amalgam 4 of mercury with an alloy of bismuth and indium is arranged, accommodated in a holder 40. The holder 40 is made of an IR-absorbing glass and has an opening 40*a*.

The lamp vessel 1 is fastened to a housing 5 with a lamp cap 50. A supply unit 25 for supplying the coil 2 is accommodated in the housing 5 and connected to contacts 51, 52 of the lamp cap 50.

The collar 13 is made of metal, here a CrNiFe alloy, comprising 6% Cr, 42% Ni, and 52% Fe by weight in this case, and the support 3 of the auxiliary amalgam 30 is fastened to the collar 13. The cavity 11 and a portion 12 of the lamp vessel 1 enveloping the cavity 11 are made of lime glass.

Figure 2:
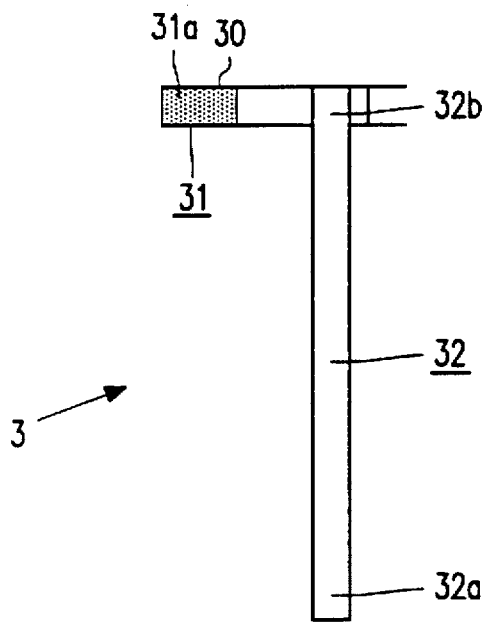
FIG. 2 shows part of the lamp of the above embodiment taken on the line II in FIG. 1.

In the embodiment shown, the support 3 (shown enlarged in FIG. 2) of the auxiliary amalgam 30 comprises a first part 31 formed by a leaf-shaped body and a second part 32 formed by a rod. The rod 32 is fastened by a first end 32*a* to the collar 13 by means of a weld 33 and supports at its second end 32*b* the leaf-shaped body 31 on which the auxiliary amalgam 30 is provided. The rod 32, which is made from the same alloy as the collar 13 of the lamp vessel 1, has a diameter of 0.6 mm and a length of 22 mm. The leaf-shaped body 31 is made of iron and has a length of 9 mm and a width of 1.6 mm. The leaf-shaped body is fastened with its longitudinal direction transverse to the end of the rod. An end portion 31*a*, 3 mm long and facing away from the rod, of the leaf-shaped body is coated with 0.1 mg indium.

A surface of the lamp vessel 1 facing towards the discharge space 10 supports a light-transmitting, electrically conducting layer 15 (thick broken lines) here made of a fluorine-doped tin oxide and extending from the collar 13 to over at least a further portion of the lamp vessel, in this case the enveloping portion 12. A luminescent layer 16 (fine broken lines) is provided over the electrically conducting layer 15 and over a surface of the cavity 11 which faces towards the discharge space 10. The collar 13 is electrically connected to a contact 52 of the lamp cap via a conductor 26.

The lamp shown in FIG. 1 was manufactured as follows. First the enveloping portion 12 of the lamp vessel 1 was fused to the collar 13. Then the electrically conducting layer 15 and the luminescent layer 16 were provided in that order. The support 3 provided with the auxiliary amalgam 30 was subsequently introduced into the discharge space 10 through the opening 13*a* in the collar 13 by means of a tool, whereupon the rod 32 of the support 3 was pressed with its first end 32*a* against a contact point of the collar 13. A laser beam was then aimed at a surface of the collar 13 situated outside the discharge space 10 opposite the point of contact between the first end 32*a* of the rod 32, whereupon the first end 32*a* of the rod 32 fused itself to the collar 13. A pulse-operated Nd-glass laser was used for this. Duration and energy of the pulse were 6 ms and 6.5 J, respectively. The beam diameter was 600 μm. Subsequently, the cavity 11 of the lamp vessel 1 already coated with a luminescent layer 16 was fused to the collar 13. The holder 40 provided with mercury and a bismuth-indium alloy was subsequently provided in the exhaust tube 14 and fixed therein between indentations 14*c*. The lamp vessel 1 was then provided with the rare gas mixture mentioned above and the exhaust tube 14 was closed by fusion. Finally, the holder 40 was fixed in the exhaust tube and opened in accordance with the method described in the previously filed Belgian Patent Application 9500896. During lamp operation, the mercury together with the bismuth-indium alloy formed the amalgam 4 which acts as the main amalgam.

Figure 3:
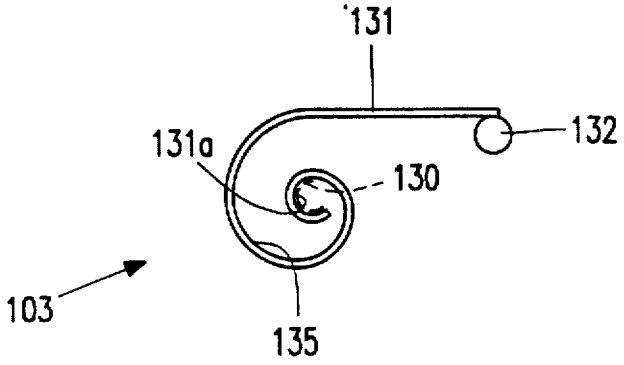
FIG. 3 shows part of a second embodiment of a lamp taken on the line III in FIG. 1.

A support of a second embodiment of the lamp according to the invention is shown enlarged in FIG. 3. Components therein corresponding to those of FIG. 2 have reference numerals which are 100 higher. At least a portion of the amalgam 130 (dotted line) is provided on an inward-facing surface 135 of a curved leaf-shaped body 131. The leaf-shaped body is here rolled into a spiral, and the amalgam 130 is entirely provided on the inward-facing surface 135 thereof. As in the first embodiment of the lamp, 0.1 mg indium is used as an amalgam former. The leaf-shaped body 131 is fastened to a rod of 43 mm length.

The collar 13 of the lamps according to the invention assumes a temperature of 120° to 130° C. during operation. This is more than 100° C. lower than the temperatures prevailing at the cavity of the lamp not according to the invention.

To test the action of the auxiliary amalgam during lamp life, lamps of the first and second embodiment (I and II, respectively) were subjected to an endurance test. The effect of the auxiliary amalgam can be ascertained from the light output gradient after lamp ignition. This gradient shows a dip because any excess mercury released by the auxiliary amalgam is not immediately absorbed by the main amalgam. The time interval $t_{90}$ in which the light output is below 90% during this dip, accordingly, is a measure for the quantity of mercury which the auxiliary amalgam is still capable of absorbing. The time interval $t_{90}$ measured for the lamps I and II after 100, 1000, 2000, 3000, and 4000 hours of operation is given in the Table below.

| | Operating period (h) | | | | |
|---|---|---|---|---|---|
| Lamp | 100 | 1000 | 2000 | 3000 | 4000 |
| I | 730 | 700 | 680 | 550 | 520 |
| II | 460 | 510 | 580 | 480 | 270 |

It is clear from the measurements that the auxiliary amalgam still functions satisfactorily in both embodiments also after 4000 hours of operation. The time required for achieving 80% of the maximum light output in lamps I and II was 5 and 10 s, respectively. Good results were also achieved with a support carrying 5 mg of the alloy PbSn as the amalgam former. With the lamps of U.S. Pat. No. 4,622,495, where the support of the amalgam is fastened to the cavity, the amalgam was already fully degenerated within 2000 h.

We claim:

1. An electrodeless low-pressure discharge lamp which comprises a lamp vessel which is closed in a gastight manner, which surrounds a discharge space, which contains a filling of mercury and a rare gas, and which has a cavity and a collar where said cavity is open towards the exterior;

an electric coil being accommodated in said cavity; and a support with an amalgam positioned in the discharge space, characterized in that: the collar is made of metal and the support of the amalgam is fastened to the collar.

2. An electrodeless low-pressure discharge lamp as claimed in claim 1, characterized in that the support of the amalgam is fastened to the collar with a weld.

3. An electrodeless low-pressure discharge lamp as claimed in claim 2, characterized in that the support comprises a first part on which the amalgam is provided and a second part by means of which the first part is fastened to the collar of the lamp vessel.

4. An electrodeless low-pressure discharge lamp as claimed in claim 3, characterized in that at least a portion of the amalgam is provided on an inward-facing surface of a curved leaf-shaped body.

5. An electrodeless low-pressure discharge lamp as claimed in claim 4, characterized in that the lamp vessel carries a light-transmitting, electrically conducting layer on a surface facing the discharge space, which layer extends from the collar over at least a further portion of the lamp vessel.

6. An electrodeless low-pressure discharge lamp as claimed in claim 3, characterized in that the support comprises a first part on which the amalgam is provided and a second part by means of which the first part is fastened to the collar of the lamp vessel.

7. An electrodeless low-pressure discharge lamp as claimed in claim 1, characterized in that at least a portion of the amalgam is provided on an inward-facing surface of a curved leaf-shaped body.

8. An electrodeless low-pressure discharge lamp as claimed in claim 2, characterized in that at least a portion of the amalgam is provided on an inward-facing surface of a curved leaf-shaped body.

9. An electrodeless low-pressure discharge lamp as claimed in claim 1, characterized in that the lamp vessel carries a light-transmitting, electrically conducting layer on a surface facing the discharge space, which layer extends from the collar over at least a further portion of the lamp vessel.

10. An electrodeless low-pressure discharge lamp as claimed in claim 2, characterized in that the lamp vessel carries a light-transmitting, electrically conducting layer on a surface facing the discharge space, which layer extends from the collar over at least a further portion of the lamp vessel.

11. An electrodeless low-pressure discharge lamp as claimed in claim 3, characterized in that the lamp vessel carries a light-transmitting, electrically conducting layer on a surface facing the discharge space, which layer extends from the collar over at least a further portion of the lamp vessel.

* * * * *